US007390011B1

(12) United States Patent
Hem

(10) Patent No.: US 7,390,011 B1
(45) Date of Patent: Jun. 24, 2008

(54) SPACE SAVER

(76) Inventor: Kheam Hem, 7384 Via Cresta Rd., San Diego, CA (US) 92129

( * ) Notice: Subject to any disclaimer, the term of this patent is extended or adjusted under 35 U.S.C. 154(b) by 189 days.

(21) Appl. No.: 11/497,123

(22) Filed: Aug. 1, 2006

(51) Int. Cl.
*B65D 33/02* (2006.01)

(52) U.S. Cl. ..... 280/638; 280/47.34; 280/47.41; 220/9.2; 220/666

(58) Field of Classification Search ..... 280/638, 280/36, 639, 47.34, 79.11, 79.2; 220/9.1, 220/9.2, 6, 666
See application file for complete search history.

(56) References Cited

U.S. PATENT DOCUMENTS

D155,161 S 9/1949 Jacobson
3,014,516 A * 12/1961 Mueller ..... 220/9.2
3,608,600 A 9/1971 Lehrman
4,036,361 A * 7/1977 Jacobson et al. ..... 206/597
4,180,113 A * 12/1979 Liebling ..... 383/7
4,915,329 A 4/1990 Doninger
5,356,024 A 10/1994 Ho et al.
5,464,113 A * 11/1995 Ho et al. ..... 220/9.2
5,611,554 A 3/1997 Eckloff
6,089,394 A 7/2000 Ziglar
6,315,143 B1 * 11/2001 Dotts ..... 220/9.2
6,520,365 B2 * 2/2003 Schneider ..... 220/9.2
6,702,143 B2 3/2004 Wang
6,830,170 B2 * 12/2004 Abel ..... 224/634

* cited by examiner

*Primary Examiner*—Christopher Ellis
*Assistant Examiner*—Brian Swenson
(74) *Attorney, Agent, or Firm*—Lawrence J. Gibney, Jr.

(57) ABSTRACT

This is a device, which will allow the storage of laundry in the upright position but also allow the device to be stowed easily when not storing laundry. Because of the ability of the device to be compressed, stowage is easily accomplished. Handles are provided on the top surface of the hamper for ease of storage.

4 Claims, 4 Drawing Sheets

SPACE SAVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to saving space, particularly when storing or stowing various items such as laundry.

B. Prior Art

There are a great number of prior art references related to the storage of laundry and collapsible hampers. A representative example of this type of device is contained in Ho, U.S. Pat. No. 5,356,024. Ho is a collapsible hamper for storage of laundry and other items. However, it does not have the structure and cannot expand in the same manner as the present device. Another representative example of a prior art is Giglar, U.S. Pat. No. 6,089,394. This is also a collapsible hamper for the storage of laundry but again it has a completely different structure.

BRIEF SUMMARY OF THE INVENTION

This is a device that allows an individual to store a great deal of laundry when needed but also collapses to a very convenient level when it is not being used.

The device itself will have a base, which will rest on four wheels. The wheels will be allowed to rotate on the base and two of the wheels will probably be locked into place. The wheels would also be made of a hard material such as plastic to traverse many different types of terrains. The base is rectangular and would have a structure upon which would rest a collapsible storage device. The collapsible storage device could be extended to a predetermined height but also collapsed to a comfortable height for storage purposes. A series of interlocking members, which would be contained within the shell or frame of the device, will enable the device to have the ability to expand or retract easily.

Handles which telescope, in the center of the top will be provided to push or pull the device. Separate handles on the side of the top of the hamper lip will also be provided. The handles on the top will also telescope for the ease of use of the user of this device.

A separate rotatable handle which will also be connected to the top of the hamper lip will be provided. The rotatable handle will rotate from side to side but also can be locked in position if desired.

It is an object of this device to be able to stow or store laundry conveniently and also allow the device to be transported easily from room to room.

DETAILED DESCRIPTION OF THE EMBODIMENT

Figure 1:
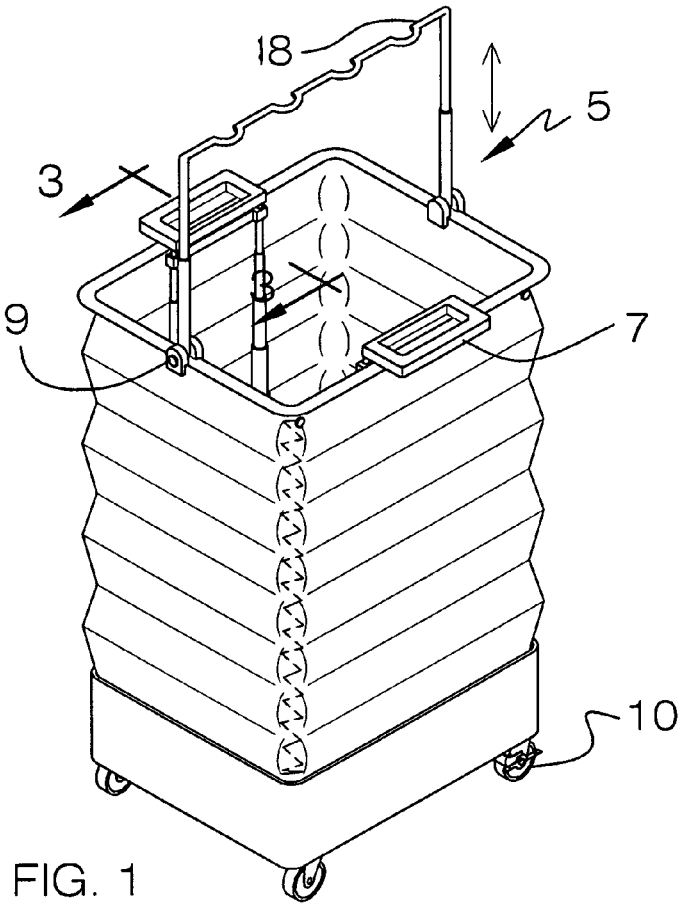
FIG. 1 is an isometric view of the device expanded.
Figure 6:
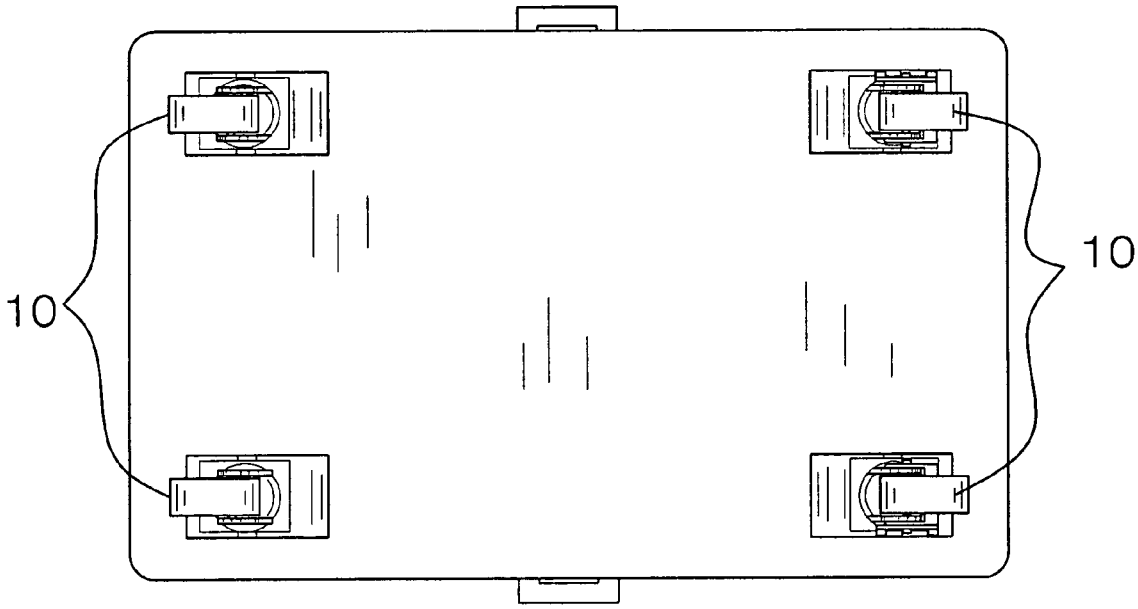
FIG. 6 is a bottom view of this device.

This device 5 is a hamper. It will rest on a base 8. The base 8 will rest on a plurality of wheels 10, which are connected to the bottom of the base. FIGS. 1, 6 A variety of different types of wheels may be used, but it is anticipated that the wheels would be of a hard material such as neoprene, rubber or plastic and wide enough to traverse many different types of surfaces.

Figure 2:
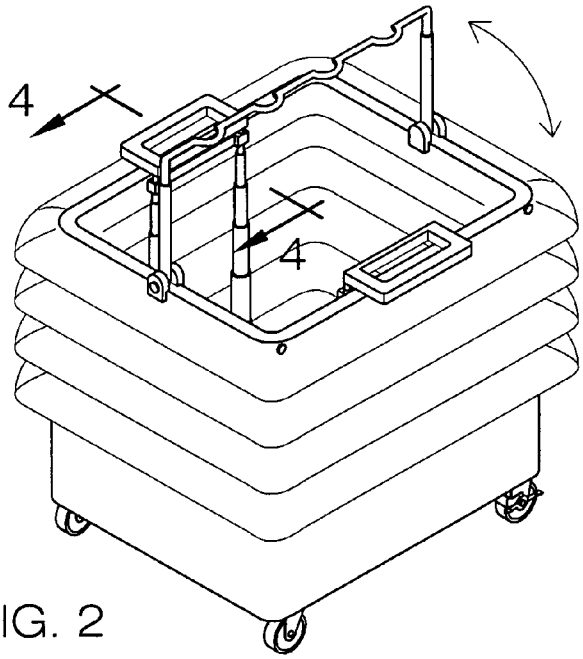
FIG. 2 is an isometric view of the device collapsed.
Figure 3:
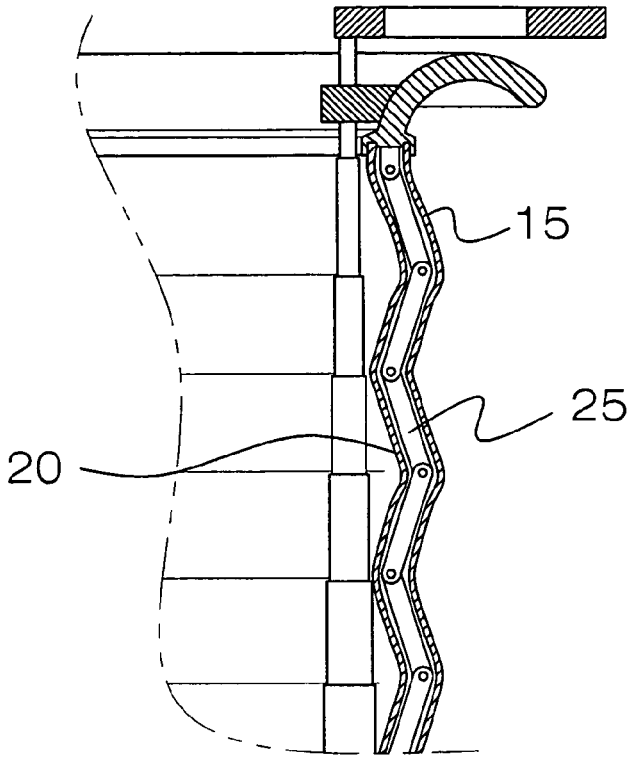
FIG. 3 is a view according to line 3-3 on FIG. 1.

The device can be fully expanded such as shown in FIG. 1 or fully compressed as shown in FIG. 2. The hamper material would be elastic yet durable to achieve the stated purpose of this device. The hamper would be hollow in the center to place dirty laundry and have an inner 20 and outer 15 shell. FIG. 3

Figure 4:
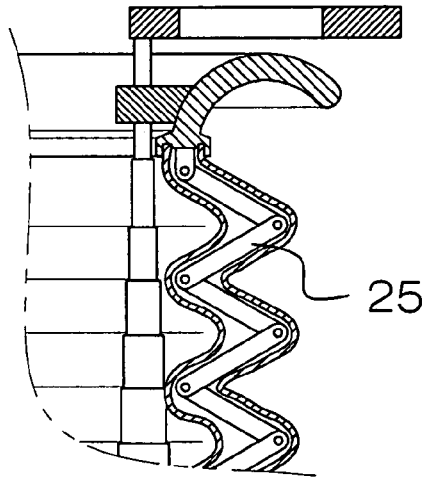
FIG. 4 is a view according to line 4-4 on FIG. 2.

Within the inner 20 and outer shell 15 of the hamper is a plurality of members 25, which are connected together at the ends of the respective members. The means to connect the respective ends may include rivets or a nut and bolt combination. There are a plurality of members of predetermined lengths 25, which are connected together in a hinged fashion at the respective ends. This interconnection allows the expansion and retraction of the device. FIGS. 3,4

The top of the hamper lip is a hard durable material to enable the individual to easily pull the device up or push the device down. On the sides of the hamper lid are handles 7, which allow the user to quickly expand or retract the device across the top of the hamper lip as well as easily push or pull. These handles will also telescope within the hamper. A handle 18 which rotates approximately ninety degrees from side to side, to either remain flush with the top of the hamper lid or perpendicular to it is also provided. A push button release 9 allows the rotatable handle to be locked in place. FIG. 1

Figure 5:
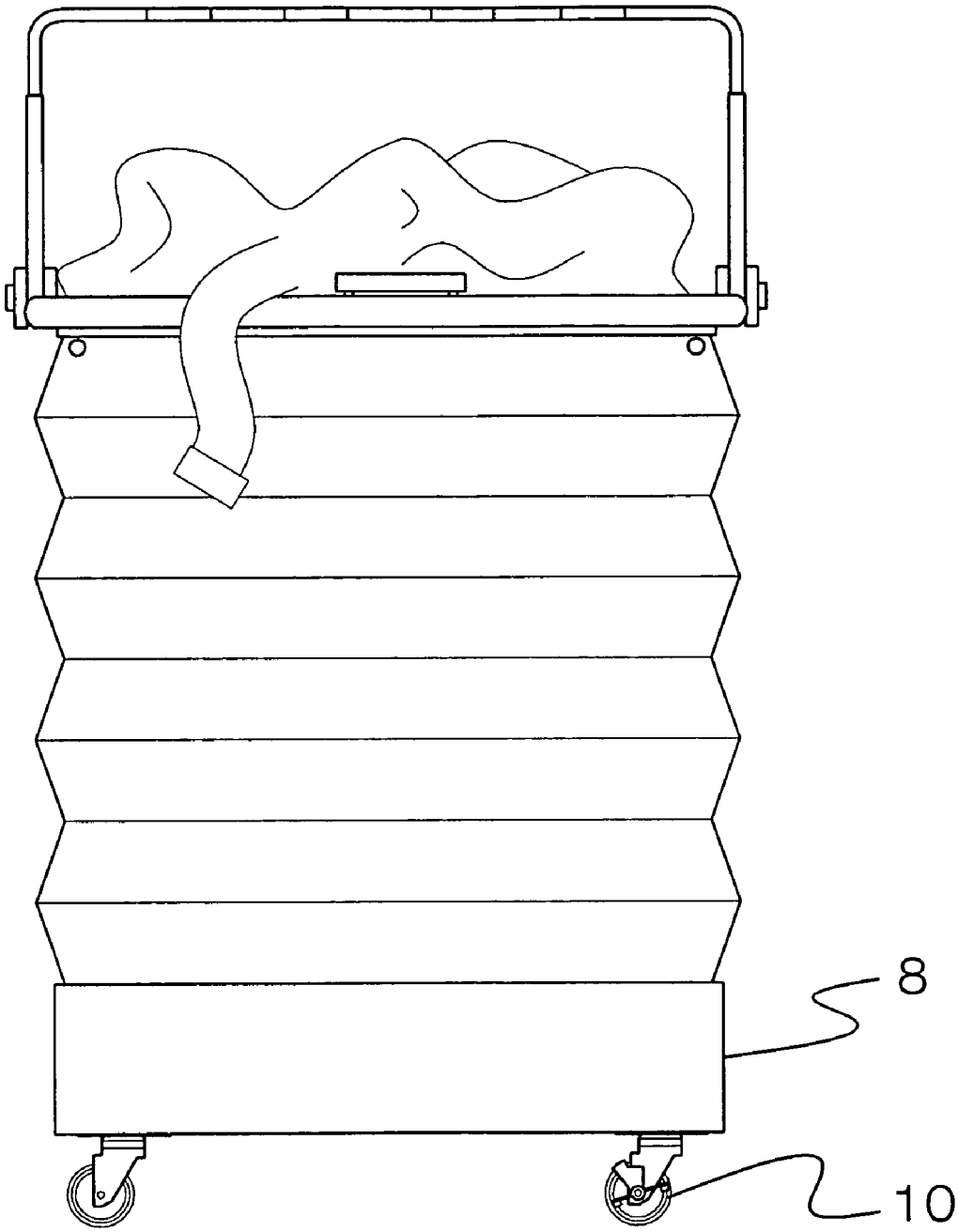
FIG. 5 is a front view of the device in the expanded mode.

Resting on the body will be a number of wheels such as shown and depicted in FIG. 5 to allow the device to be pushed and pulled over a variety of terrains or ground surfaces. Possible choices for the wheel material include caster wheels, neoprene or rubber.

The inventor claims:

1. A collapsible hamper, which is comprised of:

a. a base;

wherein the base is essentially rectangular;

wherein a plurality of wheels is secured to the base;

b. hamper material;

wherein the hamper material has a first end and the second end;

wherein the first end is connected to the base;

wherein the second end ends with a lip;

wherein the lip allows the individual to pull up or push down on the hamper material;

wherein the hamper material extends from the first end of the base to the lip;

c. wheels;

wherein a plurality of wheels are attached to the base;

wherein a plurality of wheels support the base;

d. interconnecting members;

wherein a plurality of interconnecting members are placed between the inner and outer shells formed by the hamper material;

wherein a means to connect the ends of the interconnecting members is provided;

e. handle;

wherein said handle is secured to the top lip of the hamper material;

wherein a plurality of handles extend a predetermined distance from the hamper lip;

wherein a plurality of handles are provided on the sides of the hamper lip;

wherein the handles telescope;

f. rotatable handle;

wherein a rotatable handle is secured to the hamper lip;

said handle rotates and locks in position.

2. The wheels as described in claim 1 are caster wheels.

3. The wheels as described in claim 1 are neoprene.

4. The wheels as described in claim 1 are rubber.

* * * * *